US007081038B2

(12) United States Patent
Ina

(10) Patent No.: US 7,081,038 B2
(45) Date of Patent: Jul. 25, 2006

(54) POLISHING METHOD AND APPARATUS

(75) Inventor: Hideki Ina, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/003,447

(22) Filed: Dec. 6, 2004

(65) Prior Publication Data

US 2005/0130561 A1 Jun. 16, 2005

(30) Foreign Application Priority Data

Dec. 15, 2003 (JP) ..... 2003-415854

(51) Int. Cl.
*B24B 49/00* (2006.01)

(52) U.S. Cl. ..... 451/5; 451/285

(58) Field of Classification Search ..... 451/5, 451/41, 57, 9, 10, 285–289, 63
See application file for complete search history.

(56) References Cited

U.S. PATENT DOCUMENTS 6,110,021 A * 8/2000 Ota et al. ..... 451/159
6,270,392 B1 * 8/2001 Hayashi et al. ..... 451/5
6,736,696 B1 * 5/2004 Peng et al. ..... 451/1
2002/0019198 A1 * 2/2002 Kamono ..... 451/41

FOREIGN PATENT DOCUMENTS

JP 2002-25958 1/2002

OTHER PUBLICATIONS

Nihon Veeco, New Criteria for the Symmetry of Alignment Mark's Profile by Atomic Force Profiler, Sep. 2002, The 63rd Science Lecture Meeting of the Society of Applied Physics (Preliminary Text) p. 640, and English translation thereof (3 pages).

* cited by examiner

*Primary Examiner*—Dung Van Nguyen
(74) *Attorney, Agent, or Firm*—Fitzpatrick, Cella, Harper & Scinto

(57) ABSTRACT

Provided is a polishing method of polishing a substrate by rotating the substrate and a pad while keeping the pad in contact with the substrate, the method including: a first polishing step of polishing the substrate by rotating the substrate and the pad in a first direction; and a second polishing step of polishing the substrate by rotating the substrate and the pad in a second direction opposite to the first direction.

9 Claims, 14 Drawing Sheets

POLISHING METHOD AND APPARATUS

BACKGROUND OF THE INVENTION

1. Field of the Invention

The present invention generally relates to a polishing method and apparatus. In particular, the present invention relates to a polishing method and apparatus for semiconductor wafers of Si, GaAs, InP, etc. and substrates, such as quartz substrates and glass substrates with a plurality of island-like semiconductor regions formed on the surfaces thereof.

2. Related Background Art

With progress in microfabrication of semiconductor devices, there are needs for highly precise planarization of outer surfaces of semiconductor wafers of Si, GaAs, InP, etc. and substrates, such as quartz substrates and glass substrates on the surface of which a plurality of island-like semiconductor regions are formed. Further, global planarization of the outer surfaces of substrates is also demanded due to the emergence of SOI wafers and the necessity for three-dimensional integration.

In addition to such global planarization of substrates, chemical mechanical polishing (CMP) devices, for example, are conventionally known as a type of planarization techniques capable of micro-planarization.

FIG. 16 is a schematic sectional view showing the main configuration of a chemical mechanical polishing (hereinafter referred to as "CMP") apparatus 1000. The CMP apparatus 1000 has a wafer chuck 1010 for holding a wafer W as a work with its surface to be polished facing down, and a polishing table 1020 which is placed so as to face the wafer W held on the wafer chuck 1010 and to which a polishing pad P formed of, e.g., polyurethane and having a diameter greater than that of the wafer W is attached. The CMP 1000 is further provided with an abrasive material supply means 1030 for supplying an abrasive material (slurry) S onto the polishing pad P.

In the CMP apparatus 1000, the wafer W and the polishing pad P are rotated by a driving means (not shown) in the direction indicated by the arrows, with the surface of the wafer W to be polished being in contact with the polishing pad P and a predetermined processing pressure being applied to the wafer W; at the same time, the abrasive material S is dripped onto the polishing pad P from the abrasive material supply means 1030 to polish the surface of the wafer W to be polished. Regarding the driving of the wafer W and the polishing pad P, when the rotating speeds (RPMs) of the wafer W and the polishing pad P are equalized, the linear speed of the polishing pad P becomes constant at an arbitrary position on the wafer W, which is desirable for global planarization. However, the grid-like groove pattern in the surface of the polishing pad P is transferred to the polished surface of the wafer W, thus making it impossible to achieve micro-planarization. In view of this, it is common practice to perform polishing with a deviation of several percent between the rotating speeds of the wafer W and the polishing pad P.

As shown in FIG. 17, on the surface of the substrate be polished, such as a wafer, there is arranged, in addition to a device pattern DP for forming a semiconductor device, a mark for measurement (hereinafter referred to as the "measurement mark") (alignment mark) AM for effecting positioning on an alignment detection system for an overlay inspection device, an exposure device, etc. As shown in FIG. 17, also on the measurement mark AM, there is formed a film C in which an insulating film, a dielectric, etc. are stacked together. During the polishing process, the portion of the film C on the measurement mark AM is polished simultaneously with the portion of the film C on the device pattern DP. Here, FIG. 17 is a schematic sectional view showing how the device pattern and the measurement mark are arranged on the surface of the wafer to be polished.

Generally speaking, a device pattern to be planarized by a CMP apparatus is a minute pattern of 1 μm or less, and, in the current state of mass production, 0.9 μm or less, whereas the size of measurement mark is approximately 30 μm to 300 μm, and the line width used is approximately 1 μm to 30 μm. Further, in a CMP apparatus, polishing is effected with a viscoelastic polishing pad, such as a polyurethane pad, so that, due to deformation of the polishing pad during polishing, the portions where the projections and depressions are not dense are not polished flat, resulting in so-called dishing, erosion, and thinning. Thus, in the film portion on the measurement mark, slight projections and depressions are allowed to remain even after the planarization by the CMP apparatus, and these residual slight projections and depressions make it possible to perform alignment measurement and overlay inspection measurement.

However, the configuration of the measurement mark for alignment measurement and overlay inspection measurement is under the influence of dishing, erosion, and thinning, and the size of the measurement mark is relatively large, in particular, in width, as compared with the device pattern, which leads to a difference in the peripheral pattern density, resulting in over-polishing or the like. As a result, the configuration of the measurement mark becomes asymmetrical, which leads to a deterioration in accuracy in alignment and overlay inspection.

The actually used system for the alignment detection system for the overlay inspection device, exposure device, etc. is mostly of a bright visual field image processing type, which is constructed as shown in FIG. 18. An alignment detection system 2000 detects a measurement mark AM formed on a wafer W by using the imaging action of the optical system, and forms its image on a CCD 2020 serving as the imaging device through an optical system 2010, and various signal processings are performed on the video signal, thereby performing alignment measurement or overlay inspection. Here, FIG. 18 is a schematic block diagram showing the construction of the bright visual field image processing type alignment detection system 2000.

The most needed imaging performance in the optical system of the alignment detection system is image symmetry. However, when, as shown in (a) of FIG. 19, the film C on the measurement mark AM is asymmetrical, lights A through D vertically impinging on the measurement mark AM are reflected at different angles, and the reflection lights A' through D' effect imaging on the CCD to undergo photoelectric conversion, becoming a video signal as shown in (b) of FIG. 19. At this time, the reflection angles of the lights reflected from the right and left sides of the measurement mark AM differ, so that the video signal is also asymmetrical, which leads to distortion, resulting in positional deviation. This leads to a deterioration in alignment accuracy and overlay inspection accuracy. Here, (a) of FIG. 19 is a schematic sectional diagram showing how reflection lights are reflected at different angles by the measurement mark, and (b) of FIG. 19 is a diagram showing the video signal obtained through photoelectric conversion of the reflection lights shown in (a) of FIG. 19.

In this way, in the conventional CMP apparatus, the film on the measurement mark is polished asymmetrically, so that the positioning accuracy deteriorates in the alignment detection system for the overlay inspection device, exposure device, etc.

In view of this, the inventor of the present invention has proposed a method according to which asymmetrical polishing of the film on the measurement mark is prevented through control of the rotating speed of the semiconductor substrate and/or the polishing pad (see, for example, Japanese Patent Application Laid-Open No. 2002-25958).

However, due to the recent rapid progress in the microfabrication technique for semiconductor devices, it has become impossible to meet the requisite level of alignment accuracy and overlay inspection accuracy even through polishing while controlling the rotating speed of the semiconductor substrate and/or the polishing pad. In other words, while the control of the rotating speed of the semiconductor substrate and/or the polishing pad makes it possible to mitigate asymmetrical polishing of the film on the measurement mark, it does not enable the film on the measurement mark to be polished symmetrically but allows generation of slight asymmetric diversity.

SUMMARY OF THE INVENTION

It is an exemplified object of the present invention to provide a polishing method and apparatus suitable for measurement of a mark previously formed on a substrate.

According to an aspect of the present invention, there is provided a polishing method of polishing a substrate by rotating the substrate and a pad while keeping the pad in contact with the substrate, the method including: a first polishing step of polishing the substrate by rotating the substrate and the pad in a first direction; and a second polishing step of polishing the substrate by rotating the substrate and the pad in a second direction opposite to the first direction.

According to another aspect of the present invention, there is provided a polishing apparatus for polishing a substrate, the apparatus including: a pad; a driving system to rotate the substrate and the pad while keeping the pad in contact with the substrate; and a control system to control the driving system so that the substrate is polished through rotation of the substrate and the pad in a first direction and rotation of the substrate and the pad in a second direction opposite to the first direction.

According to the present invention, it is possible to provide a polishing method and apparatus suitable for measurement of a mark previously formed on a substrate.

Other objects and advantages besides those discussed above shall be apparent to those skilled in the art from the description of a preferred embodiment of the invention which follows. In the description, reference is made to accompanying drawings, which form apart thereof, and which illustrate an example of the invention. Such example, however, is not exhaustive of the various embodiments of the invention, and therefore reference is made to the claims which follow the description for determining the scope of the invention.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENTS

In providing a polishing method and a polishing apparatus making it possible to polish a film on a measurement mark for positioning or the like with projections and depressions into a symmetrical configuration, the inventor of the present invention, going back to the basics, has carefully examined the asymmetric diversity of the film on the measurement mark generated by polishing, and has found out that when, in a CMP apparatus, the rotational direction of the wafer and the polishing pad is reversed, the asymmetric diversity of the film on the measurement mark after CMP is also reversed. Further, the inventor has found out that the CMP polished amount is proportional to the polishing time irrespective of the rotational direction of the wafer and the polishing pad. Further, the inventor has found out that the asymmetric diversity of the film on the measurement mark is only generated during the last section of the entire polishing time.

Figure 1:
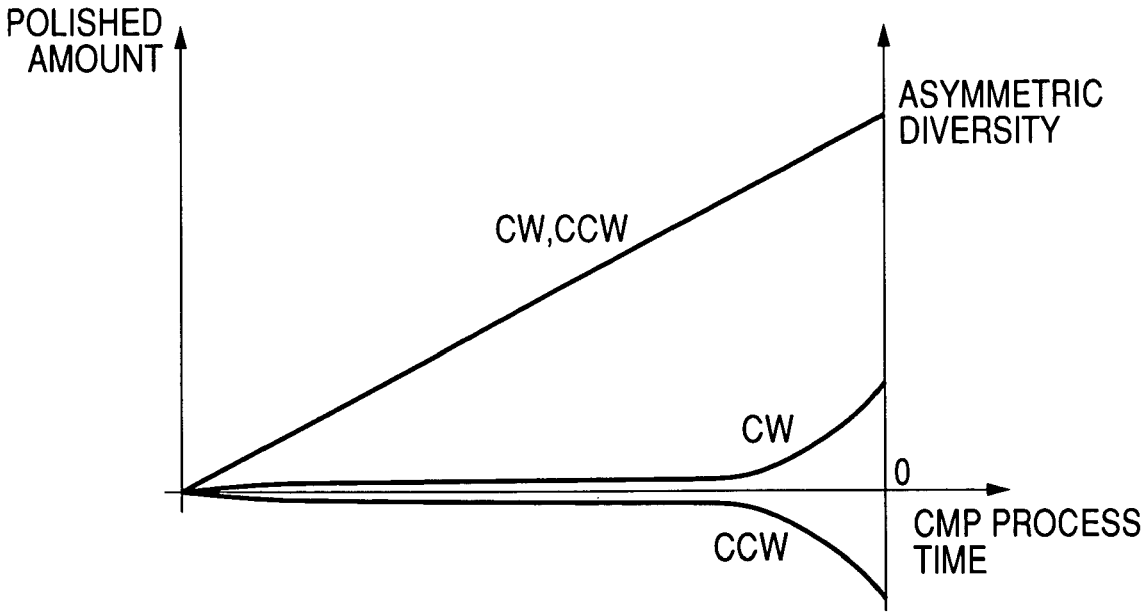
FIG. 1 is a graph showing the relationship of the asymmetric diversity and polished amount of a film on a measurement mark with respect to CMP process time.

FIG. 1 is a graph showing the relationship of the asymmetric diversity and polished amount of the film on the measurement mark with respect to CMP process time. In FIG. 1, symbol CW indicates one of the rotational directions of the wafer and of the polishing pad, and symbol CCW indicates a rotation in a direction opposite to the rotational direction CW. The horizontal axis indicates CMP process time, and the vertical axis indicates the asymmetric diversity and polished amount of the film on the measurement mark.

Referring to FIG. 1, the polished amount is proportional to the CMP process time irrespective of the rotational direction CW or CCW. On the other hand, the asymmetric diversity of the film on the measurement mark is not generated in the initial stage of polishing start, but is generated at a certain point in time in the final section of the entire polishing time, the direction of the asymmetric diversity being reversed depending on whether the rotational direction is CW or CCW. Further, the polished amount of the actual device is proportional to the CMP process time and does not depend on the rotational direction.

Regarding the quantification of the asymmetric diversity causing rotational alignment error in the measurement mark on the wafer immediately after CMP, the inventor of the present invention has read a paper in "The 63rd Science Lecture Meeting of the Society of Applied Physics" (Preliminary Text No. 2, page 640, 27 p-N-1).

Figure 2:
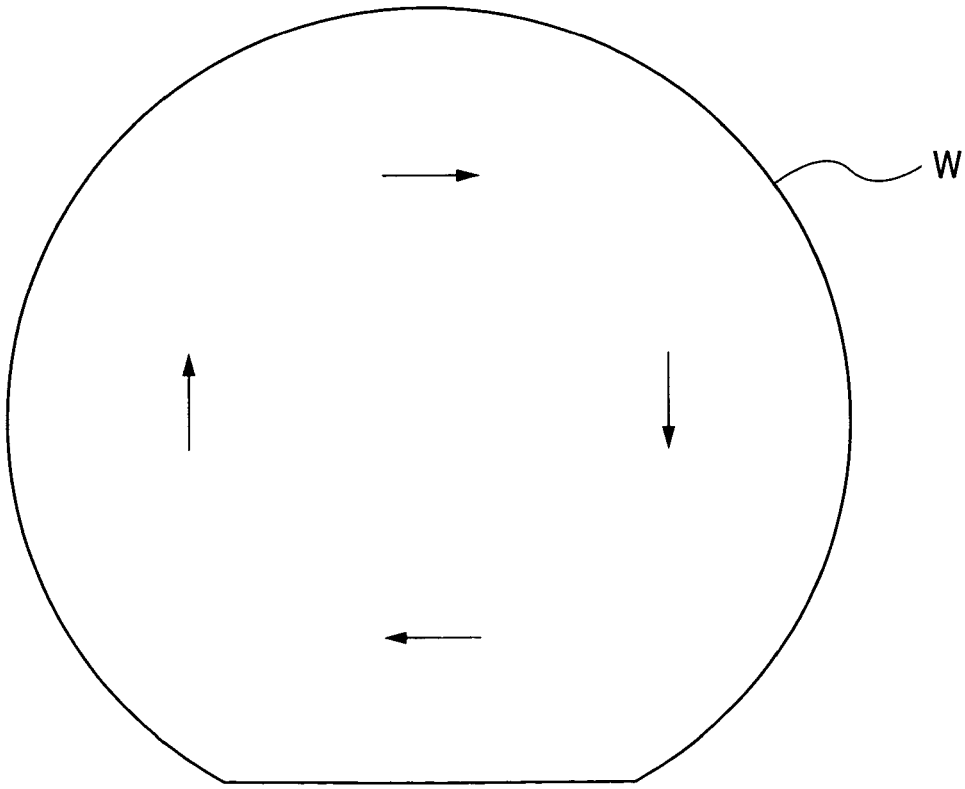
FIG. 2 is a diagram showing a rotational alignment error in a wafer in terms of vectors.

Regarding rotational alignment error, FIG. 2 schematically shows deviation amount in a wafer in terms of vectors. In the left-hand side shot in the wafer W, the arrow is directed upwards, which means the deviation is generated upwards. Similarly, in the upper shot, the deviation occurs to the right; in the right-hand side shot, the deviation occurs downwards; and, in the lower shot, the deviation occurs to the left. In the wafer W as a whole, the error generated is clockwise.

When, in the CMP apparatus, the rotational directions of the wafer and the polishing pad are reversed, the resultant alignment is, as is known in the art, such that a counterclockwise rotational error is generated in the wafer as a whole. This is due to the fact that when the rotational directions of the wafer and the polishing pad are reversed, the asymmetric diversity of the film on the measurement mark after polishing is also reversed.

Further, the inventor of the present invention performed an examination on alignment accuracy by performing polishing with a CMP apparatus under three different polishing conditions, using an exposure device in each case. The three different polishing conditions were as follows:

(Polishing Condition 1): Polishing is performed without synchronization between the wafer and the polishing pad.

(Polishing Condition 2): Polishing is performed without synchronization between the wafer and the polishing pad at first, and with synchronization between them in the end.

(Polishing Condition 3): Polishing is performed with synchronization between the wafer and the polishing pad all the time.

Figure 3:
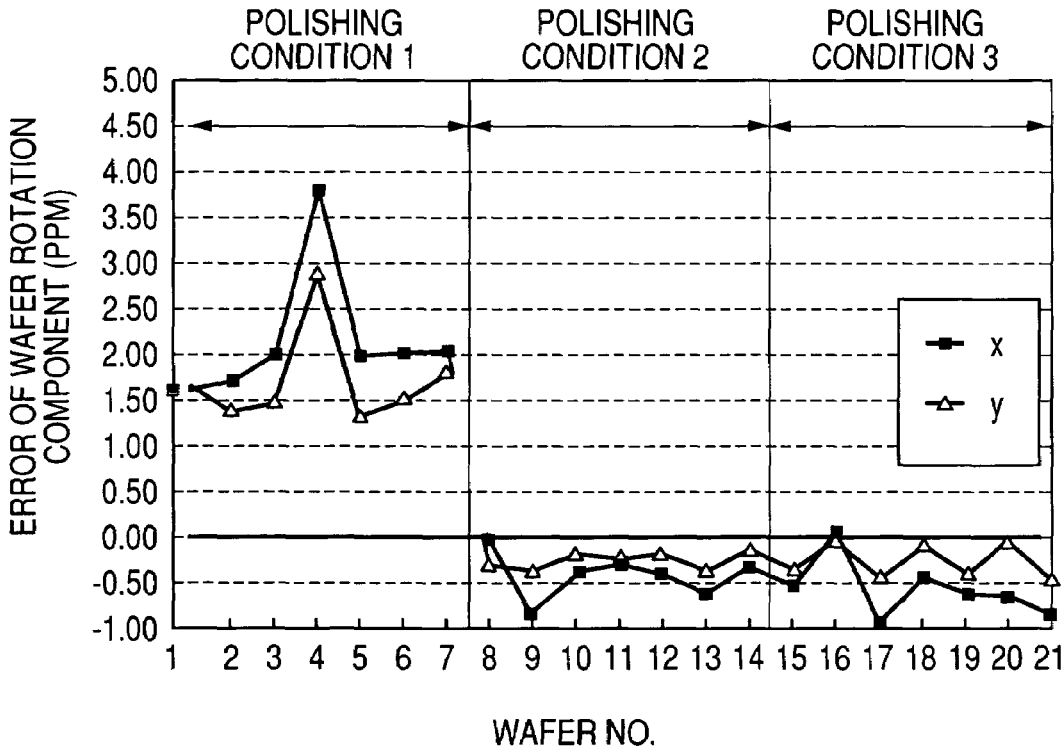
FIG. 3 is a graph showing alignment accuracy as obtained when polishing is performed by a CMP apparatus under three different polishing conditions.

FIG. 3 is a graph showing examination results on alignment accuracy as obtained when polishing is performed by the CMP apparatus under the three different polishing conditions. In FIG. 3, the vertical axis indicates a wafer rotation component error, which is an amount partially indicating the alignment accuracy (hereinafter referred to as the "rotational error"). Here, as in the case of FIG. 2, the wafer rotation component error is an error occurring when asymmetrical diversity of the measurement mark in the rotational direction with respect to the wafer center is generated; it is obtained by calculating the error in the rotation component and is indicated in terms of PPM. The horizontal axis indicates the wafer No., i.e. the numbers of wafers polished under the respective polishing conditions and aligned, and superimposed one upon the other after exposure and development before being inspected by the inspection device.

Referring to FIG. 3, under Polishing Condition 1, great rotational error is generated, whereas, under Polishing Conditions 2 and 3, no such great rotational error is generated. It is to be assumed that this is due to the fact that, under Polishing Condition 1, the configurations of the film on the alignment mark and the overlay inspection mark has asymmetric diversity leading to generation of rotational error, and that, under Polishing Conditions 2 and 3, the asymmetric diversity is not so conspicuous as under Polishing Condition 1. It is to be assumed that there is no difference between Polishing Conditions 2 and 3, so that, as shown in FIG. 2, the asymmetry in the film on the measurement mark is not generated in the early stage of the polishing period, but in the final stage of the total polishing period.

Figure 4:
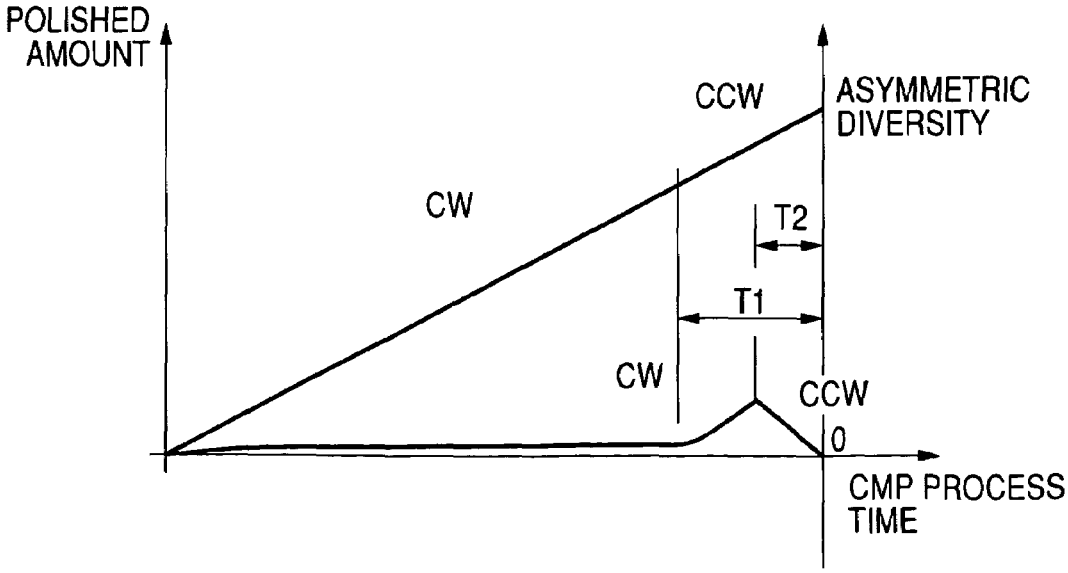
FIG. 4 is a graph showing the relationship of the asymmetrical diversity and polished amount of the film on the measurement mark with respect to the CMP process time and the rotational direction.

In the following, a preferred embodiment of the present invention will be described with reference to the accompanying drawings. In the drawings, the same components are indicated by the same reference numerals, and a redundant description thereof will be omitted. FIG. 4 is a diagram showing the principle of the present invention; it is a graph showing the relationship of the asymmetric diversity and polished amount of the film on the measurement mark with respect to the CMP process time and the rotational direction. In FIG. 4, one of the rotational directions of the wafer and the polishing pad is indicated by symbol CW, and the rotation direction opposite to the rotational direction CW is indicated by symbol CCW. Further, the horizontal axis indicates the CMP process time, and the vertical axis indicates the asymmetric diversity and polished amount of the film on the measurement mark.

Referring to FIG. 4, polishing was first performed in the rotational direction CW, and when the residual polishing time had become T1, asymmetric diversity of the film on the measurement mark was generated; when the residual polishing time had become T2, the rotational direction was changed to CCW, performing polishing to the end of the polishing time. FIG. 4 shows that when polishing has been performed to a desired polished amount, the asymmetric diversity of the film on the measurement mark is zero. The asymmetric diversity of the film on the measurement mark is generated in a linear fashion at a certain point in time, and is reversed in rotational direction; when the way the asymmetric diversity is generated after reversal is also linear, the change from T1 to T2 is linear, T2 being half T1. This shows that, by appropriately controlling the rotational direction of the wafer and the polishing pad, it is possible to polish the film on the measurement mark in a symmetric configuration.

Figure 5:
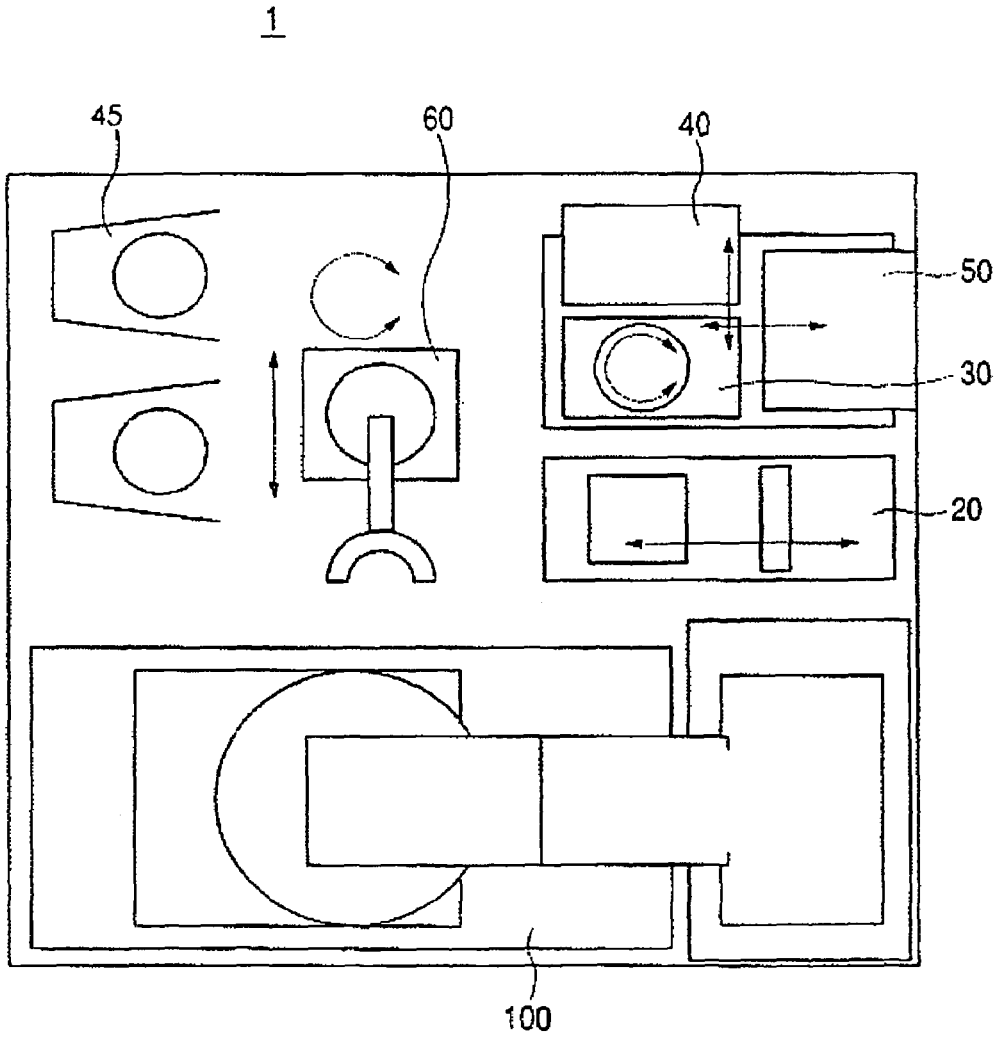
FIG. 5 is a schematic block diagram showing the construction of a polishing apparatus according to an aspect of the present invention.

Next, a CMP apparatus utilizing the above principle will be described. FIG. 5 is a schematic block diagram showing the construction of a polishing apparatus 1 according to an aspect of the present invention.

The polishing apparatus 1 is a CMP apparatus for planarizing the device forming surface of a semiconductor substrate with high accuracy. As shown in FIG. 5, the polishing apparatus 1 includes a wafer polishing portion 100 for polishing a semiconductor substrate constituting an object of processing (hereinafter referred to as the "wafer"), a cleaning portion 20 for cleaning the wafer polished in the wafer polishing portion 100, a pre-alignment portion for effecting pre-alignment on the wafer cleaned in the cleaning portion 20, and a film asymmetric diversity measurement portion 40 for measuring the asymmetric diversity of the film on the measurement mark of the wafer that has undergone pre-alignment. In the pre-alignment portion 30, mating in the rotational direction by notch reference or orientation-flat reference and positioning in the XY-directions by wafer contour reference are conducted, and, in the film asymmetric diversity measurement portion 40, the asymmetric diversity of the film on the wafer measurement mark is measured.

Further, the polishing apparatus 1 includes an XY⊖-stage 50 which holds the wafer cleaned by the cleaning portion 20 and transfers the wafer to the pre-alignment portion 30 and the film asymmetric diversity measurement portion 40, a wafer loading/unloading portion 45 for inputting and extracting the wafer accommodated in the wafer carrier to and from the polishing apparatus 1, and a conveying robot 60 for conveying the wafer.

Figure 6:
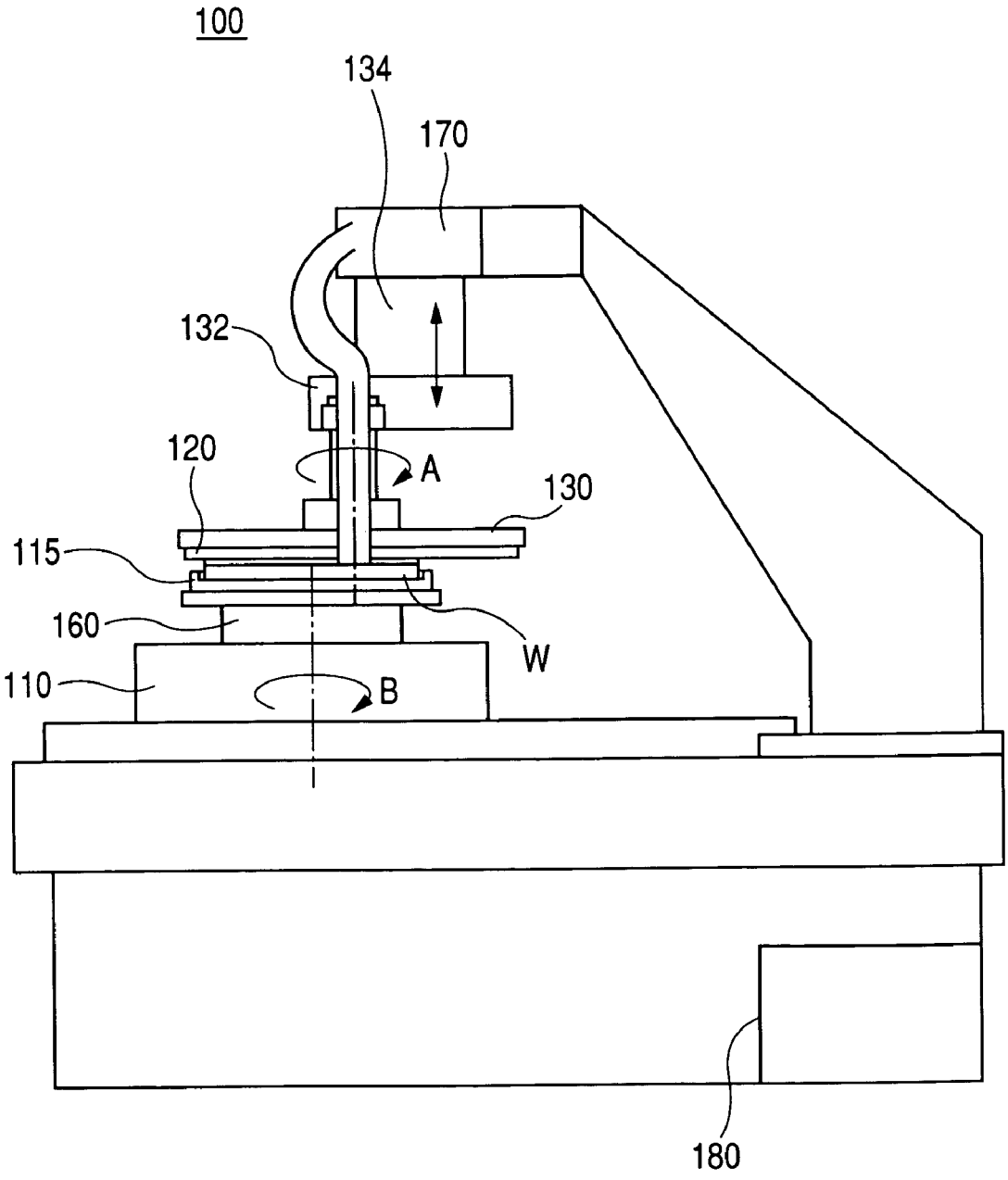
FIG. 6 is a side view of the construction of the main portion of a wafer polishing portion shown in FIG. 5.
Figure 7:
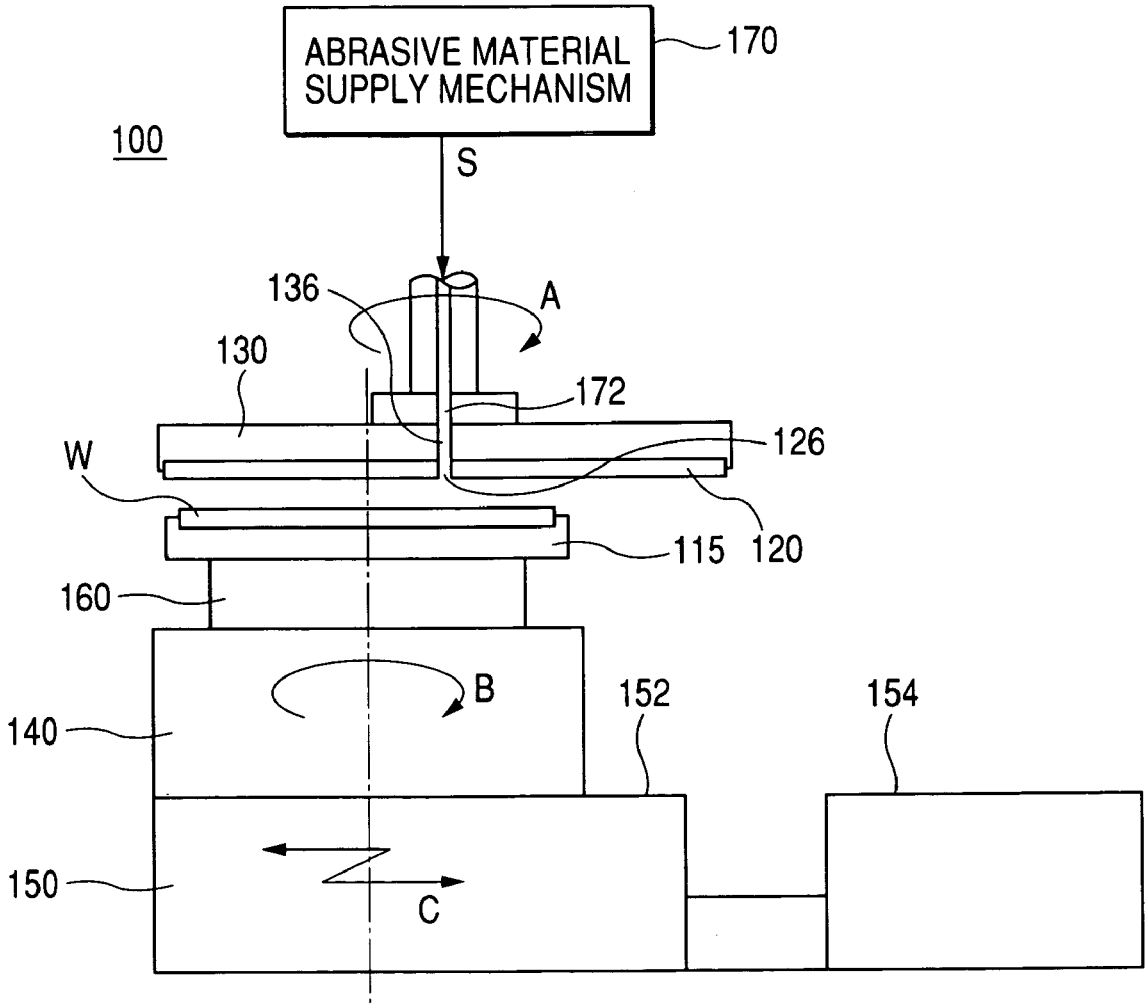
FIG. 7 is a front view of the construction of the main portion of the wafer polishing portion shown in FIG. 5.

Here, with reference to FIGS. 6 and 7, the wafer polishing portion 100 of the polishing apparatus shown in FIG. 5 will be described. FIG. 6 is a side view showing the construction of the main portion of the wafer polishing portion 100 shown in FIG. 5. FIG. 7 is a front view showing the construction of the main portion of the wafer polishing portion 100 shown in FIG. 5.

The wafer polishing portion 100 includes a wafer table 110 holding the wafer W constituting the object of processing through the intermediation of a wafer chuck 115, with the surface of the wafer W to be polished facing upwards, a polishing head 130 which is arranged above the wafer table 110 so as to be opposed to the wafer W held by the wafer table 110 and which has a diameter larger than that of the wafer W and holds a polishing pad 120 with a diameter smaller than double the diameter of the wafer W, a first driving means 132 for rotating the polishing head 130 holding the polishing pad 120 in the direction of the arrow A around the axis thereof, and a head vertical driving means 134 for vertically moving the polishing head 130 to pressurize the polishing pad 120 against the wafer W.

Further, as shown in FIG. 7, the wafer table 110 holding the wafer W includes a second driving means 140 for rotating the wafer chuck 115 holding the wafer W in the direction of the arrow B around its axis, a third driving means 150 composed of a guide portion 152 for swinging the wafer chuck 115 holding the wafer W in the horizontal direction (arrow C) and a power portion 154, and an equalizing mechanism 160 for pressurizing the entire surface of the wafer W against the polishing pad 120 with a fixed force when polishing the wafer W by the polishing pad 120.

Further, the wafer polishing portion 100 includes an abrasive material supply mechanism 170 having an abrasive material supply tube 172 communicating with small holes 136 and 126 provided at the center of the polishing head 130 and the polishing pad 120 so as to supply abrasive material (slurry) S to the region where the surface of the wafer W to be polished and the polishing pad 120 are opposed to each other. When the polishing pad 120 is formed of a material allowing the abrasive material S to pass therethrough, for example, cloth or polyurethane with large communication holes, there is no need to provide the small hole 126 in the polishing pad 120.

The abrasive material S used in this embodiment consists of a polishing liquid in which minute particles of silicon oxide, cerium oxide, aluminum oxide, zeolite oxide, chromium oxide, iron oxide, silicon carbide, boron carbide, carbon, ammonium salt or the like having a diameter on the order of several microns to sub microns and relative uniformity are dispersed in a solution, such as aqueous sodium hydroxide, aqueous potassium hydroxide, aqueous ammonium, isocyanuric acid solution, Br—$CH_3OH$, or aqueous solution of hydrochloric acid. The combination of these minute particles and the solution allows selection according to the object to be polished. For example, when polishing an Si surface, an abrasive material is suitable in which minute particles of silicon oxide, cerium oxide, ammonium salt, manganese dioxide, or the like are dispersed in a solution as mentioned above; when polishing an $SiO_2$ surface, an abrasive material is suitable in which minute particles of silicon oxide are dispersed in aqueous potassium hydroxide; in the case of a wafer whose surface consists of Al, an abrasive material is suitable in which minute particles of silicon oxide are dispersed in an aqueous solution of ammonium containing hydrogen peroxide.

The wafer polishing portion 100 is equipped with a control portion 180 which controls the first driving means 132, the head vertical driving means 134, the second driving means 140, the third driving means 150, etc. independently of or in relation to each other. Further, the control portion 180 controls the rotational direction and the rotating time of the wafer W and the polishing pad 120 in accordance with a polishing method described below.

In operating the wafer polishing portion 100, the polishing pad 120 held by the polishing head 130 is caused to abut the surface of the wafer W to be polished (the device forming surface) held by the wafer table 110 through the intermediation of the wafer chuck 115, and, at the same time, while applying a predetermined processing pressure thereto, the polishing pad 120 is rotated in the direction of the arrow A by the first driving means 132, and, further, the wafer W is rotated in the direction of the arrow B by the second driving means 140; at the same time, the abrasive material S is supplied between the polishing pad 120 and the wafer W from the abrasive material supply mechanism 170 to polish the surface of the wafer W to be polished.

Figure 8:
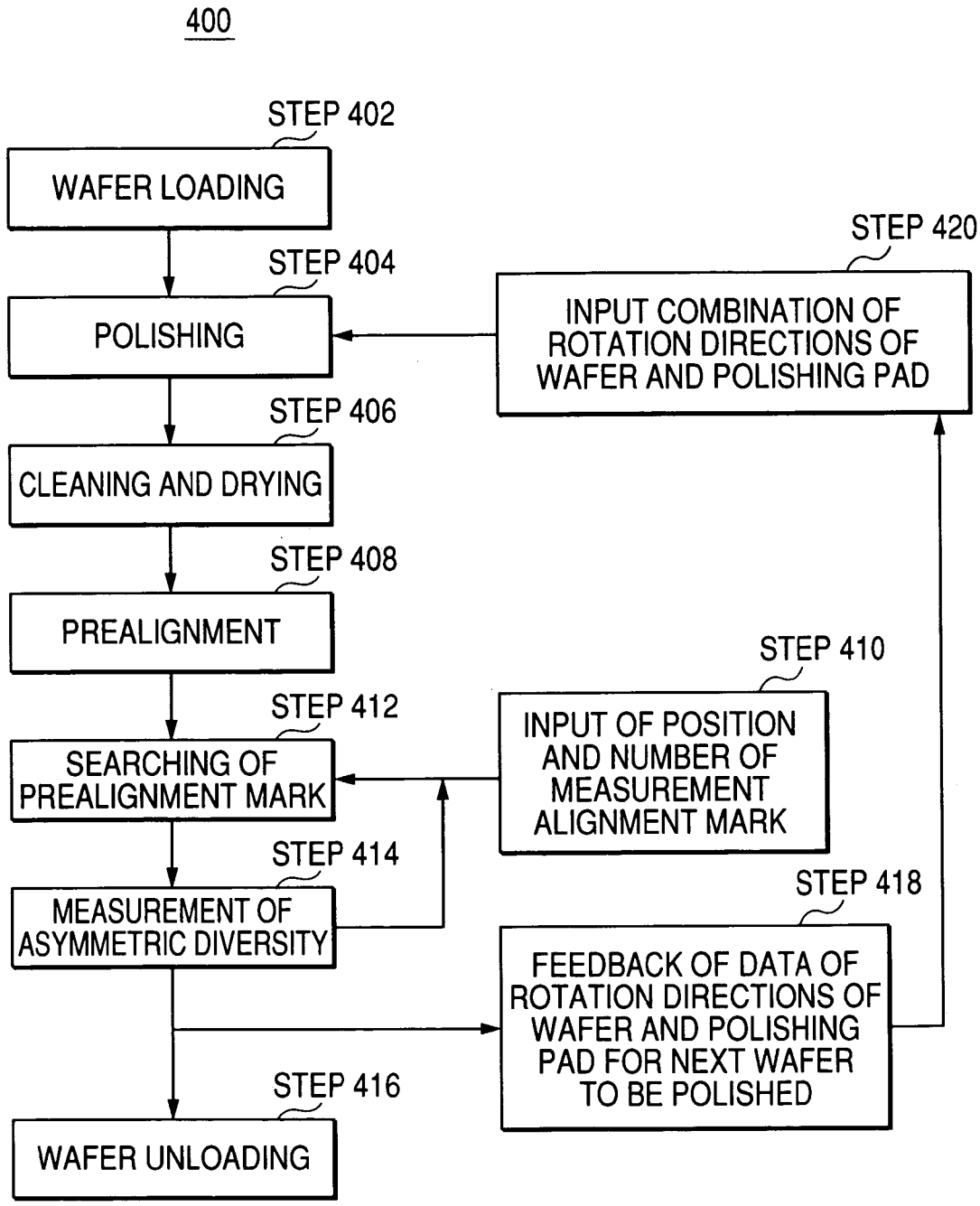
FIG. 8 is a flowchart illustrating a polishing method according to an aspect of the present invention.

In the following, the polishing method using the polishing apparatus 1 will be described with reference to FIG. 8. FIG. 8 is a flowchart for illustrating a polishing method 400 according to an aspect of the present invention. In the polishing method 400, the wafer W constituting the object of processing and the polishing pad 120 are driven in the same direction at different rotating speeds. The selection range of rotating speed for the wafer W and the polishing pad 120 is 1000 rpm or less and, more preferably, 50 to 300 rpm, with the rotational directions being the same. Further, the pressure with which the polishing pad 120 is pressed against the wafer W by the head vertical driving means 134 ranges from 0 to 100 kPa. When the rotational directions are to be reversed, the rotational directions of the wafer W and the polishing pad 120 are changed simultaneously.

Referring to FIG. 8, first, in step 402, the wafer W, accommodated in a wafer carrier placed in the wafer loading/unloading portion 45, is conveyed to the wafer polishing portion 100 by the conveying robot 60 according to a wafer loading sequence, and polishing is performed in the wafer polishing portion 100 (step 404).

The polishing is performed in accordance with the rotational directions and the rotating times of the wafer W and the polishing pad 120 as previously combined by the control portion 180 (that is, a combination of the rotational direction CW and the rotational direction CCW which is opposite to the rotational direction CW, the polishing time in the rotational direction CW, and the polishing time in the rotational direction CCW). Further, other polishing conditions, including the polishing pressure, the rotating speed of the wafer W, and the rotating speed of the polishing pad 120, are arbitrarily set beforehand, and are input through an input means (not shown), the polishing being performed according to the input values. Preferably, the difference between the rotating speeds of the wafer W and the polishing pad 120 is approximately 1 rpm to 10 rpm.

When the polishing has been completed, the wafer W is conveyed from the wafer polishing portion 100 to the cleaning portion 20 by the conveying robot 60; in the cleaning portion 20, the wafer W is cleaned and dried (step 406); thereafter, it is transferred onto the XYθ-stage 50 by the conveying robot 60.

While various methods of cleaning the wafer W are available, in order to achieve an improvement in terms of the symmetric diversity of the measurement mark, a plurality of cleaning methods are conducted, finally conducting ultrasonic cleaning using an ammonium solution, whereby it is possible to prevent the depressions of the measurement mark from being filled, for example, with grinding chips of W, Cu, the remainder of the abrasive material S, and a product generated from the wafer chuck 115 holding the wafer W, thereby preventing the configuration of the measurement mark from becoming asymmetric.

The wafer W on the XYθ-stage 50 is transferred to the pre-alignment portion 30, where mating in the rotational direction by notch reference or orientation-flat reference and positioning in the XY-directions by wafer contour reference are conducted as pre-alignment (step 408).

Next, the wafer W is transferred to the film symmetric diversity measurement portion 40 by the XYθ-stage 50. In step 410, the XYθ-stage 50 is driven in the XY-directions in accordance with the positions and number of measurement marks previously input to thereby perform measurement mark searching (step 412); thereafter, the measurement of the asymmetric diversity of the measurement marks is conducted (step 414).

Figure 9:
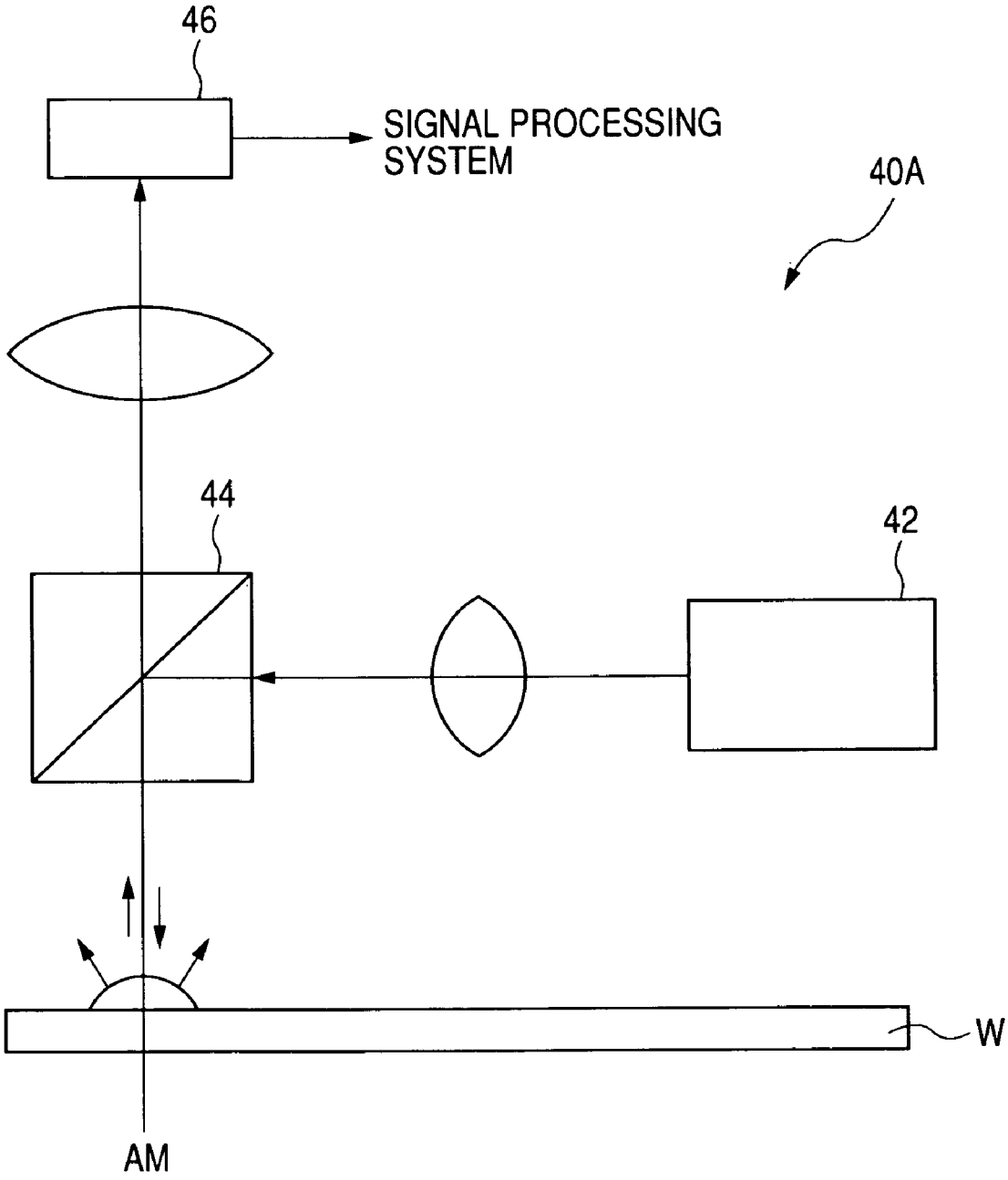
FIG. 9 is a block diagram showing the construction of a symmetry detection system constituting an example of a film symmetry measurement portion shown in FIG. 5.

For the measurement of the asymmetric diversity of the measurement marks, a measurement mark symmetry detection system 40A as shown in FIG. 9 is used. FIG. 9 is a block diagram showing the construction of the symmetry detection system 40A constituting an example of the film symmetry measurement portion 40 shown in FIG. 5. In the symmetry detection system 40A, light emitted from a light source 42 is applied to the measurement mark AM on the wafer W through an optical system 44 including a beam splitter, and the reflection light therefrom is supplied through the optical system 44 to a CCD 46 serving as an imaging device for image formation. A video signal corresponding to the image of the measurement mark formed on the CCD 46 is processed by a signal processing system, thereby measuring the symmetry of the film on the measurement mark AM.

Figure 18:
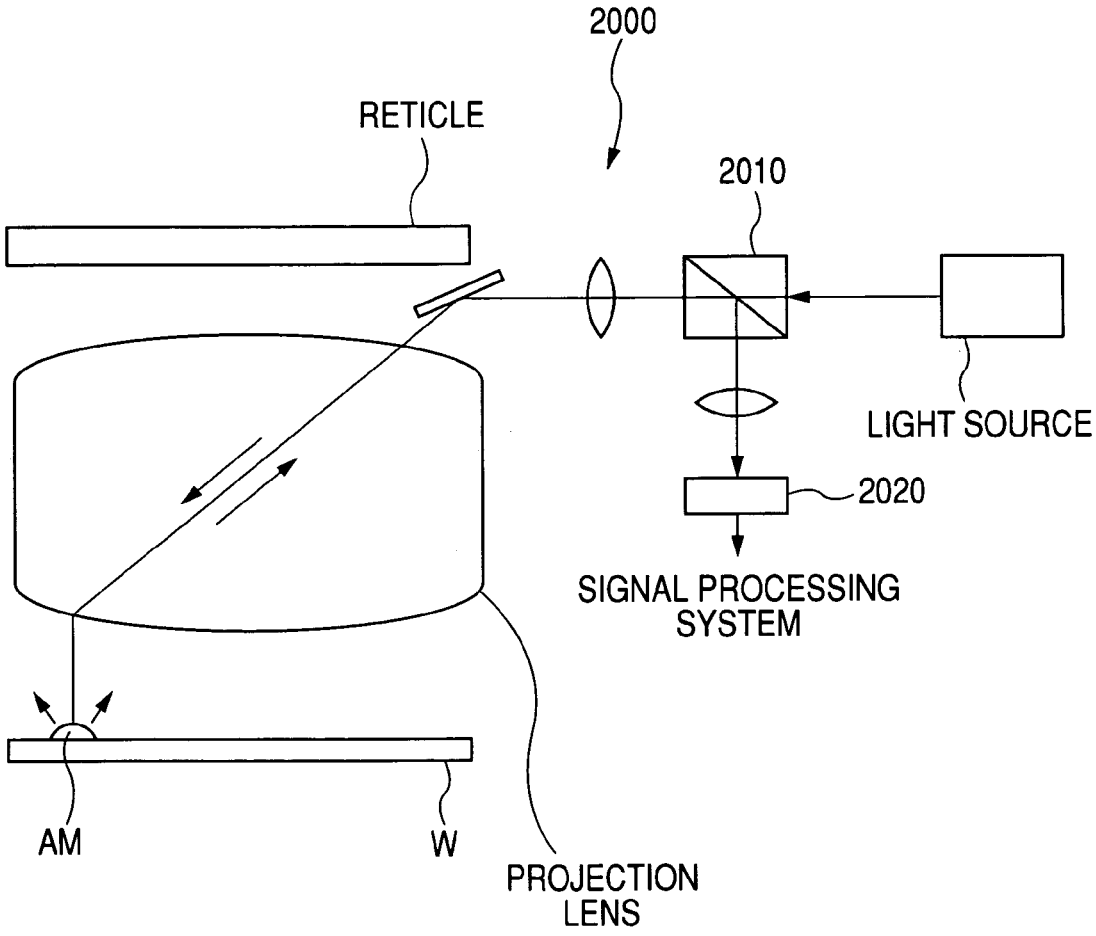
FIG. 18 is a schematic block diagram showing the construction of a bright visual field image processing type alignment detection system 200; and (a) of FIG. 19 is a schematic sectional view showing reflection lights reflected at different angles by a measurement mark, and (b) of FIG. 19 is a diagram showing a video signal obtained through photoelectric conversion of the reflection lights shown in (a) of FIG. 19.
Figure 19:
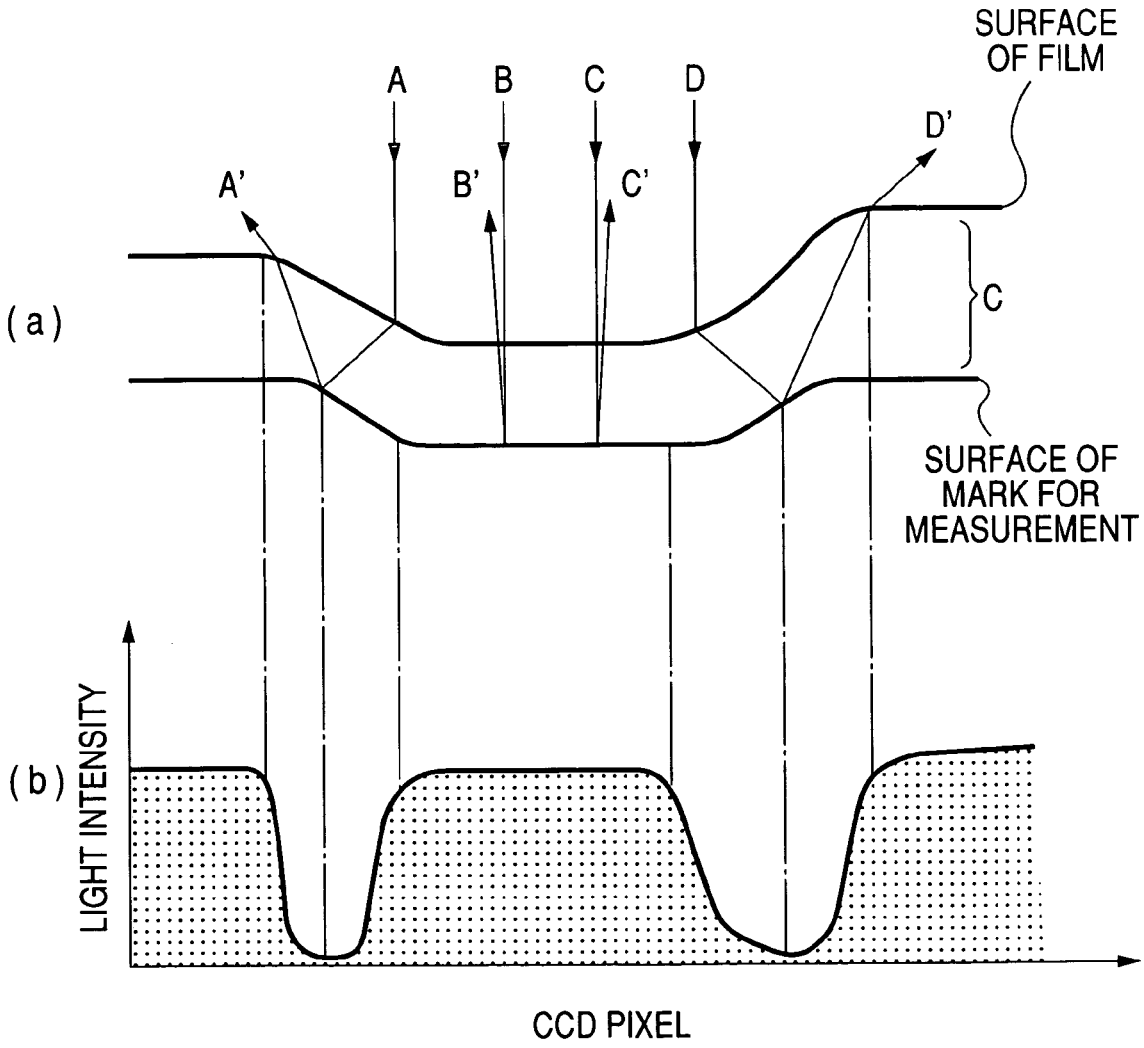

The measurement of the symmetry of the film on the measurement mark will be described below. The detecting principle of the symmetry detection system 40A is basically the same as that of the bright visual field image processing type alignment detection system shown in FIG. 18 except that light is not passed through a projection optical system. Further, the number of measurement marks to be measured can be arbitrarily set from an input means (not shown); preferably, the number selected ranges from approximately two to eighteen. In this regard, by selecting a plurality of measurement marks in the same circumference, it is possible to achieve an improvement in correction accuracy.

The asymmetric diversity of each measurement mark thus selected is measured, and, based on the asymmetric diversity measured, a database previously prepared is referred to, and the data thus obtained is fed back to the combination of the rotational directions of the wafer W and the polishing pad 120 for the polishing of the next wafer W (step 418), and the combination of the rotational directions of the wafer W and the polishing pad 120 to be polished next is appropriately corrected (step 420).

The wafer W that has undergone the measurement of the asymmetric diversity of the measurement marks is accommodated in the wafer carrier of the wafer loading/unloading portion 45 by the conveying robot 60 (step 416).

Figure 10A:
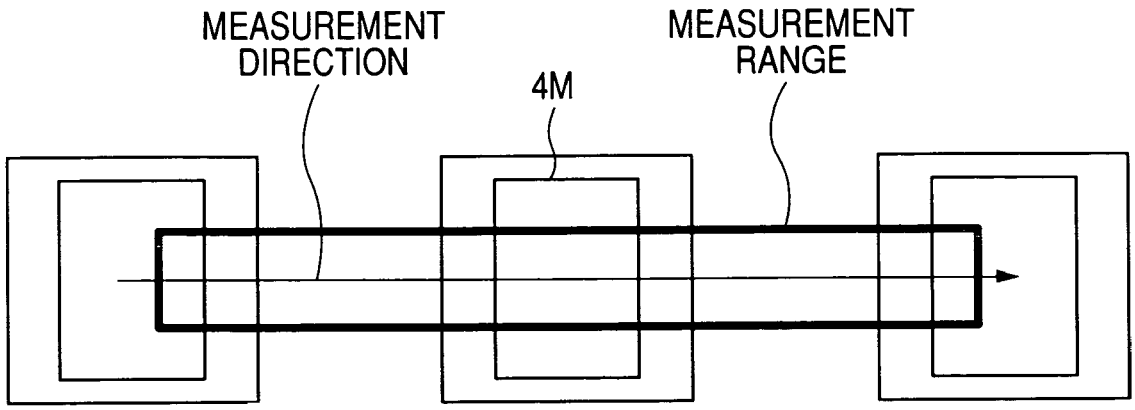
FIGS. 10A and 10B are diagrams for illustrating the measurement of the asymmetric diversity of a measurement mark.
Figure 10B:
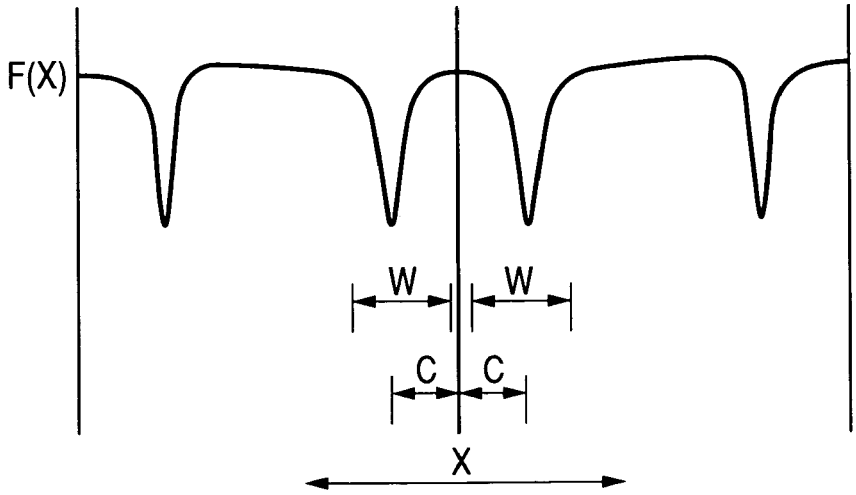

Here, the measurement of the asymmetric diversity of the measurement mark will be illustrated. FIGS. 10A and 10B are diagrams for illustrating the measurement of the asymmetric diversity of a measurement mark. When template matching is effected such that the measurement range for the measurement mark AM imaged on the CCD 46 of the symmetry detection system 40A is in the positional relationship as shown in FIG. 10A, a measurement signal as shown in FIG. 10B is obtained. The measurement signal obtained from the measurement mark AM in the measurement range central portion varies in two chevrons with respect to the measurement direction. A midpoint between two intersections obtained by slicing the measurement signal at a certain slice level is obtained, and this midpoint is regarded as the central position of the measurement mark; and the difference in the distance from the central position to the peak of each chevron will be referred to as the degree of symmetry of the measurement mark.

According to another method of measuring the asymmetric diversity of the measurement mark, the measurement signal varying in two chevrons is folded back at the center to obtain a difference. As shown in FIG. 10B, the following signal processing is performed on the measurement signal X obtained.

First, the minimum value of the absolute value of M(X) obtained by the following equation 1 is obtained, and the value obtained by dividing this minimum value by W is defined as the degree of symmetry (equation 2).

$$M(X) = \sum_{j=C-W/2}^{C+W/2} F(X+j) - F(X-j) \quad \text{(Equation 1)}$$

$$\text{Degree of Symmetry} = M(X)/W \quad \text{(Equation 2)}$$

In the equations, W and C are coefficients determined by the kind of measurement mark, the magnification of the symmetry detection system 40A, the number of pixels of the CCD 46, etc.

According to still another method of measuring the symmetry of the measurement mark, the measurement signal actually measured is compared with a previously stored waveform of superior symmetry, calculating the degree of symmetry through correlation of the results.

In the following, a method of determining the rotational directions of the wafer W and the polishing pad 120 based on the degree of symmetry of the measurement mark as measured and a database preparing method will be described. Polishing is actually performed previously on the film on the wafer W constituting the object of polishing in the device process through several combinations of the rotational directions of the wafer W and the polishing pad 120, i.e., of normal rotation (CW) and reverse rotation (CCW), and, based on the results obtained through measurement of the configurations of the films on the measurement marks, there is obtained the relationship between the combination of the rotational directions of the wafer W and the polishing pad 120 and the degree of asymmetric diversity of the film on the measurement mark, obtaining a combination of the rotational directions of the wafer W and the polishing pad 120 giving the optimum measurement results of asymmetric diversity (i.e., the most symmetrical one). Further, the relationship between other combinations of rotational directions and degree of asymmetrical diversity is obtained and stored in the form of a database.

Usually, in a semiconductor manufacturing process, a test wafer is caused to undergo the process in the initial stage of the production for the purpose of checking the stability of the apparatus. In the polishing apparatus 1 also, in order to check the stability of the consumable materials, such as the polishing pad 120 and the abrasive material S, a test wafer is polished prior to the polishing of the first wafer, thus checking the polishing rate, flatness, etc. In view of this, when polishing the test wafer, the asymmetric diversity of the configuration of the measurement mark is measured. When the asymmetric diversity of the configuration of the measurement mark is satisfactory (i.e., the mark is symmetrical), that polishing condition is adopted for the next wafer onward. When the asymmetric diversity of the measurement mark exceeds a pre-set threshold value, the database, in which the relationship between a plurality of combinations of rotational directions and degree of asymmetric diversity is stored, is referred to, thus making it possible to obtain a combination of rotational directions corresponding to that asymmetric diversity.

In this way, when the polishing apparatus 1 is equipped with the film symmetry measurement portion for measuring the degree of asymmetric diversity, polishing is performed while feeding back data on each wafer to be polished, whereby, if the factors causing changes with time of the polishing pad 120 vary during the processing of one lot, it is possible to perform polishing symmetrically on the film on the measurement mark in correspondence with such variation. Thus, it is possible to achieve an improvement in terms of positioning accuracy and overlay inspection accuracy.

Figure 11:
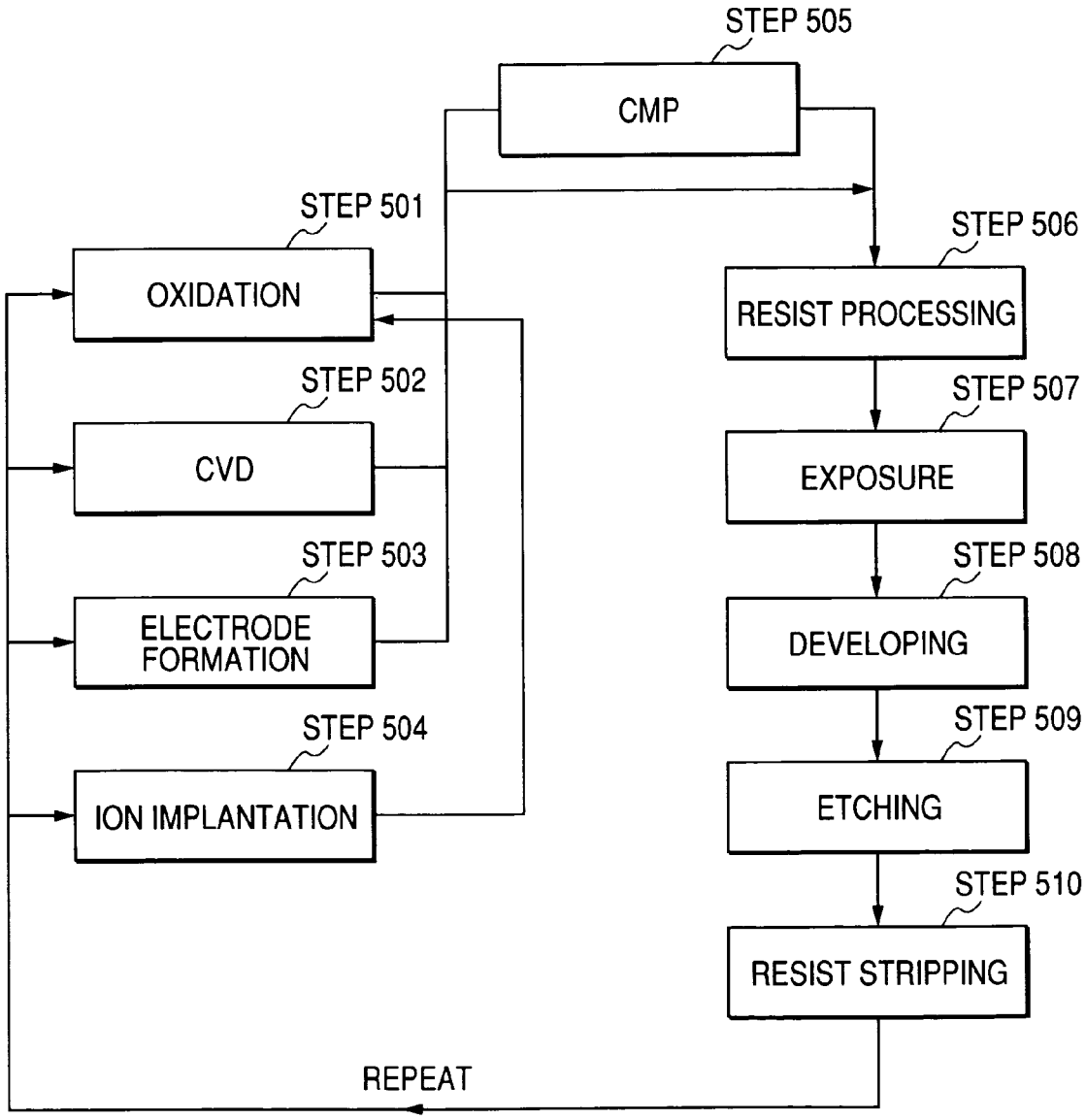
FIG. 11 is a flowchart illustrating a device manufacturing process.

The wafer W polished in the wafer polishing portion 100 undergoes a cleaning process in the cleaning portion 20, and is further transferred to the next device manufacturing step, thus manufacturing a device through successive processing procedures. FIG. 11 is a flowchart illustrating a device manufacturing process.

Referring to FIG. 11, step 501 (oxidation) is a process of oxidizing the wafer surface, step 502 (CVD) is a process of forming an insulating film on the wafer surface, step 503 (electrode formation) is a process of forming an electrode on the wafer by evaporation, and step 504 (ion implantation) is a process of implanting ions into the wafer, step 505 (CMP) is a process of performing CMP on the wafer surface by using the above-described polishing apparatus 1, step 506 (resist processing) is a process of applying resist to the wafer, step 507 (exposure) is a process of printing and exposing mask circuit patterns side by side in a plurality of wafer shot areas by means of an exposure device, such as a stepper or a scanner, step 508 (developing) is a process of developing the wafer that has undergone exposure, step 509 (etching) is a process of scraping off the portion other than the developed resist image, and step 510 (resist stripping) is a process of removing the resist that has become unnecessary after the completion of the etching. These processes are conducted repeatedly approximately 10 to 30 times to thereby produce semiconductor devices.

Although not shown in FIG. 11, the semiconductor substrate, such as a wafer, on which the CMP process (step 505) has been completed is subjected to a process of forming thereon a desired film as designated through device design, e.g., an insulating film, a barrier metal film, or a wiring metal film; in some cases, the semiconductor substrate is then transferred to apparatuses for lithography (a coater/developer for resist application and development, an overlay inspection device, and an exposure device, such as a stepper or a scanner).

In the above-described example, the rotational directions CW and CCW are changed for each rotation. This is effective in the case in which the variation in the asymmetric diversity of the measurement mark (with respect to polishing time) occurs to a small degree or the variation is linear, or in the case in which the manner of its variation after changing the rotational directions in polishing remains the same or approximately the same as that before the changing or the rotational directions.

Figure 12:
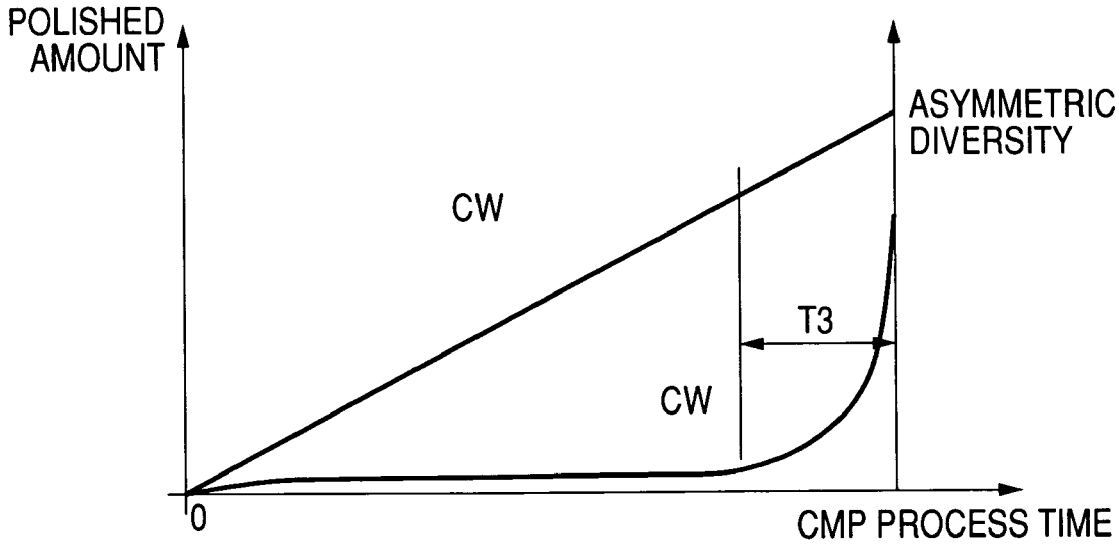
FIG. 12 is a graph showing the relationship of the asymmetrical diversity and polished amount of the film on the measurement mark with respect to the CMP process time and the rotational direction when abrupt variation in the asymmetrical diversity of the measurement mark occurs.

However, when, as shown in FIG. 12, the asymmetric diversity of the measurement mark changes abruptly during the remaining period T3 after the completion of polishing, the rotational directions CW and CCW are ideally used each for one rotation (only CCW during T4). However, a problem will be involved if a deviation of some sort is generated.

Figure 13:
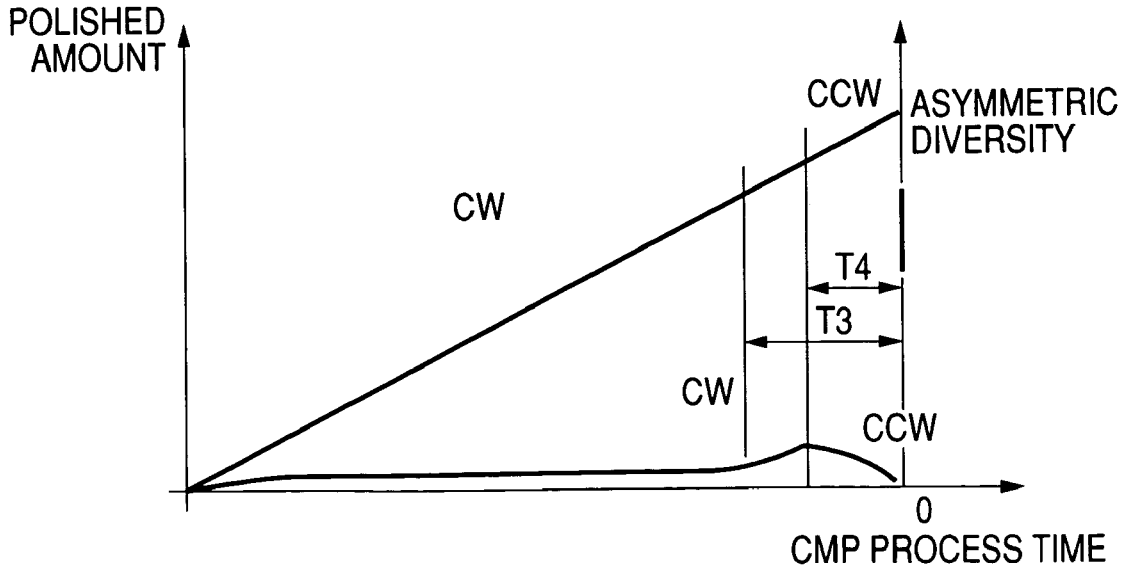
FIG. 13 is a graph showing the relationship of the asymmetrical diversity and polished amount of the film on the measurement mark with respect to the CMP process time and the rotational direction when ideal control is performed on the rotational direction in a case in which abrupt variation in the asymmetrical diversity of the measurement mark occurs.

It should be noted that FIG. 13 shows a case in which the variation in the asymmetric diversity of the measurement mark after the changing of the rotational direction differs from that before the changing and in which, after the change in rotational direction, the variation ceases to be abrupt.

Figure 14:
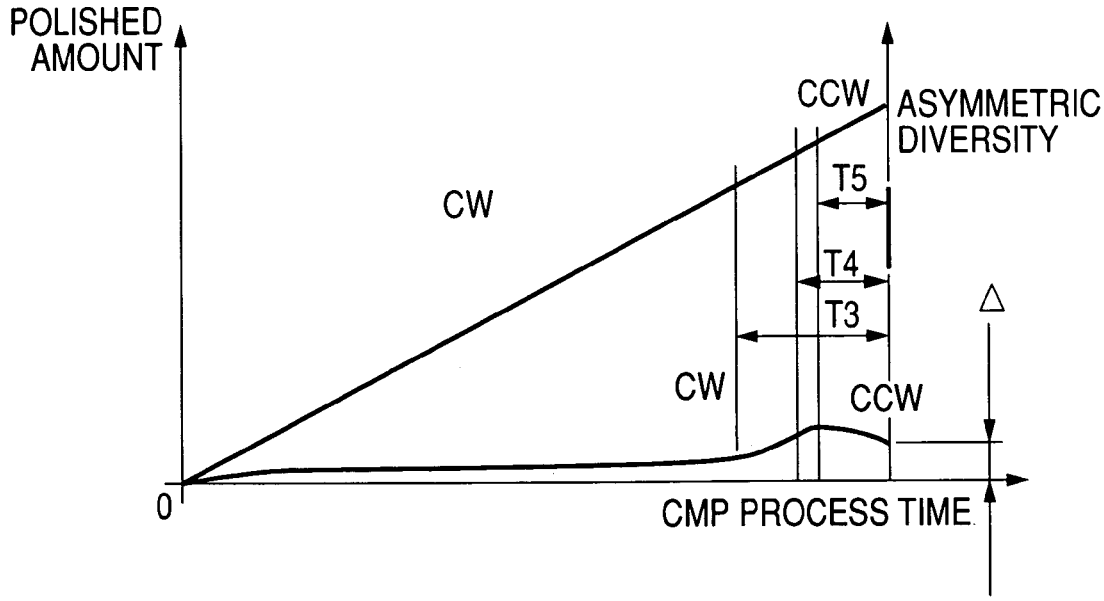
FIG. 14 is a graph showing the relationship of the asymmetrical diversity and polished amount of the film on the measurement mark with respect to the CMP process time and the rotational direction when control is erroneously performed on the rotational direction in a case in which abrupt variation in the asymmetrical diversity of the measurement mark occurs at a certain point in time.

FIG. 14 shows a case in which the variation in the asymmetric diversity of the measurement mark is changed abruptly at a certain point in time and in which a deviation from ideal is generated due to erroneous change in the rotational direction. As shown in FIG. 14, when the remaining polishing time has become T4, polishing is performed with the rotational direction changed from CW to CCW; suppose, however, polishing is performed with the rotational direction changed from CW to CCW only when the remaining polishing time has become T5, which is less than T4. In this case, when the polishing time has been terminated, asymmetric diversity in the measurement mark configuration is generated by Δ, making it impossible to achieve the object of the present invention.

Even in the case shown in FIG. 4, if any error is generated, the asymmetric diversity of the configuration of the measurement mark is not reduced to zero, which, however, does not mean a serious problem since the value is not so large. In contrast, when, as shown in FIG. 14, the asymmetric diversity of the configuration of the measurement mark changes abruptly, even a slight error will lead to such a great amount as will not allow correction, which is rather serious.

Figure 15:
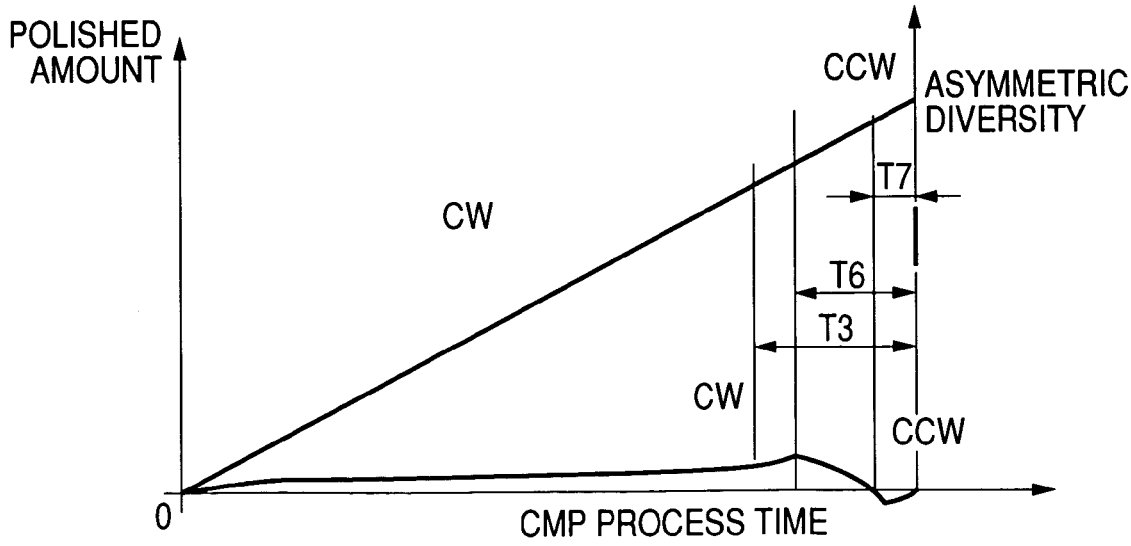
FIG. 15 is a graph showing the relationship of the asymmetrical diversity and polished amount of the film on the measurement mark with respect to the CMP process time and the rotational direction when generation of asymmetrical diversity of the measurement mark is to be prevented in a case in which abrupt variation in the asymmetrical diversity of the measurement mark occurs.
Figure 16:
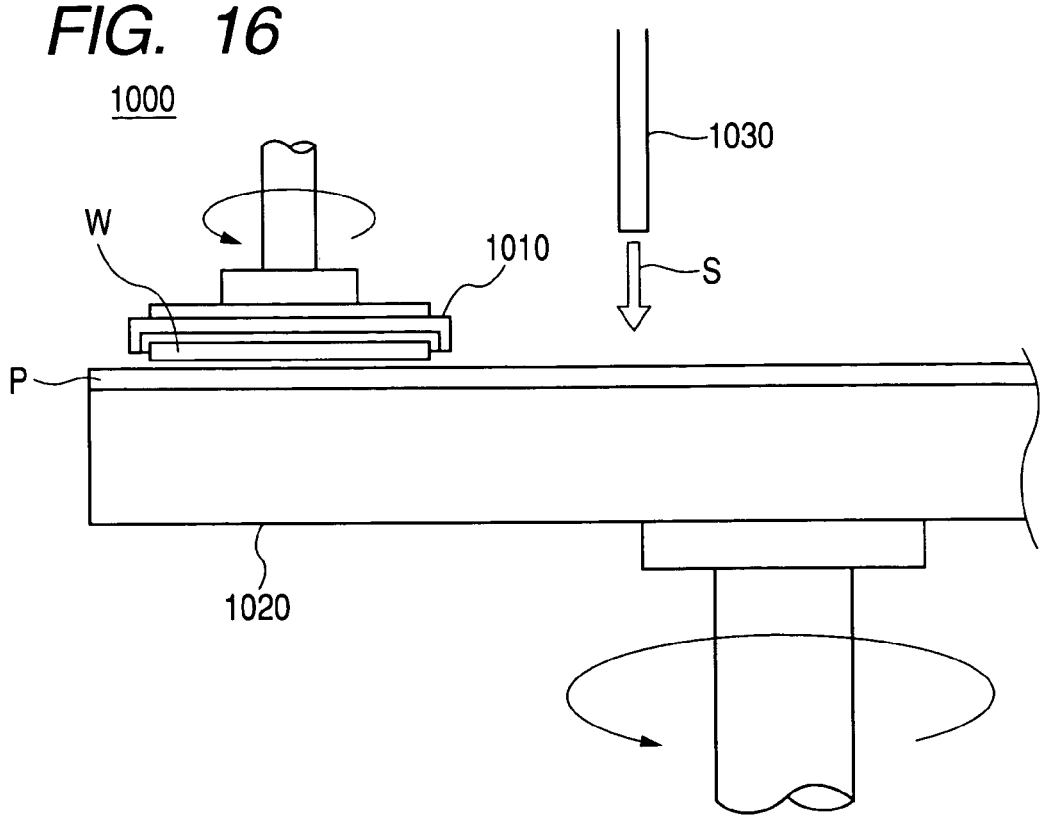
FIG. 16 is a schematic sectional view showing the construction of the main portion of a conventional CMP apparatus.
Figure 17:
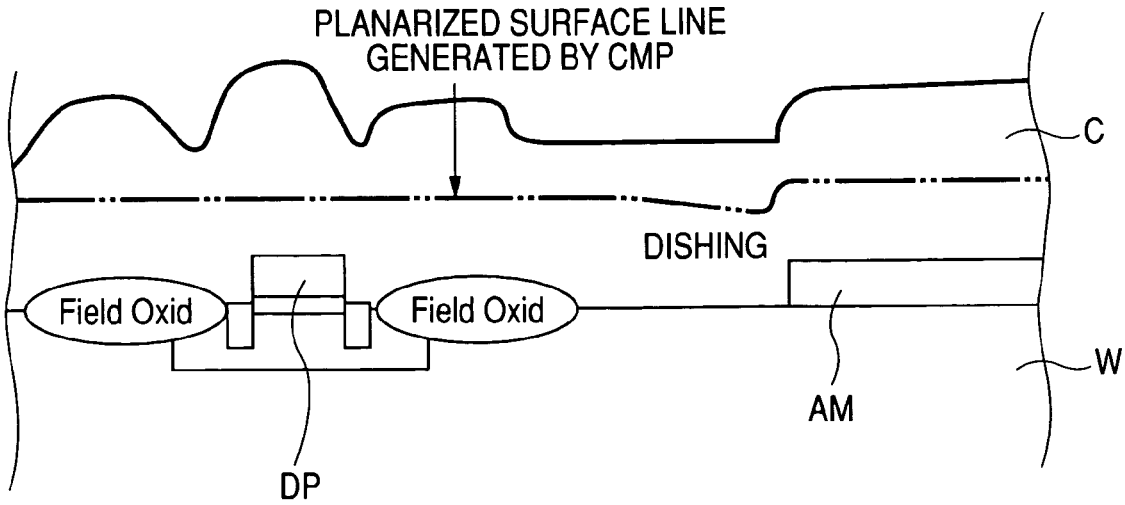
FIG. 17 is a schematic sectional view showing how a device pattern and a measurement mark are arranged on the surface of a wafer to be polished.

In view of this, as shown in FIG. 15, the rotational direction in polishing is changed three times in total: CW, CCW, and CW, whereby it is possible to prevent generation of asymmetric diversity in the measurement mark. As shown in FIG. 15, by selecting a combination in which the rotational direction is changed before the variation in the asymmetric diversity in the configuration of the measurement mark becomes abrupt, the asymmetric diversity in the configuration of the measurement mark is generated only in a permissible amount even if some error is generated.

While in FIG. 15 the rotational direction is changed three times in total: CW, CCW, and CW, this should not be construed restrictively. What is important is that the asymmetric diversity in the configuration of the measurement mark be generated only in a permissible amount even if some error is generated by selecting a combination which causes a change in the rotational direction in polishing before the variation in the asymmetric diversity of the measurement mark changes abruptly.

According to the present invention, polishing is performed while reversing the rotational directions of the wafer and the polishing pad a plurality of times, whereby it is possible to polish the film on the measurement mark isotropically. Further, by referring to the database for the data on the previous polished wafer and feeding back the result (that is, the optimum combination of wafer and polishing pad rotational directions), even if there is a change in the factors, such as the change with time of the polishing pad, it is possible to accordingly polish the film on the measurement mark in a symmetrical fashion, whereby it is possible to achieve an improvement in accuracy for overlay inspection and positioning.

While in this embodiment the film symmetry measurement portion for measuring the symmetry of the measurement mark for positioning, overlay inspection, etc. is arranged inside the polishing apparatus, it is also possible to perform the measurement of the symmetry of a wafer whose polishing has been completed outside the polishing apparatus without arranging the film symmetry measurement device inside the polishing apparatus, the obtained data on symmetry degree being input through an input means provided in the polishing apparatus.

Further, while this embodiment adopts a symmetry detection system for optically measuring the asymmetric diversity of a measurement mark as shown in FIG. 9, this should not be construed restrictively; the object of the present invention can also be achieved, for example, with an atomic force microscope (AFM).

Generally speaking, in a CMP apparatus, a primary polishing, which is a rough polishing, and a secondary polishing, which is a finish polishing, are conducted. In this regard, the secondary polishing, which is a finish polishing, may be further divided into two polishing procedures. As shown in FIG. 1, according to the findings as obtained by the inventor of the present invention, no asymmetric diversity in the configuration of the measurement mark is generated during the rough polishing; the asymmetric diversity is generated in the final stage of the polishing time for the secondary polishing.

For example, suppose a combination of one CW rotation and one CCW rotation is adopted for secondary polishing, i.e., finish polishing. Although it depends on the material of the wafer on which CMP is conducted, when polishing is to be performed in CCW rotation, it can happen that, due to the "clogging" caused in the previous polishing by CW rotation, the polishing performance (the polishing speed and the symmetry of the pattern after polishing) differs from that when ordinary polishing in the same direction is conducted from the first, thus making it impossible to exert the inherent characteristic. In such cases, an idea of tertiary polishing may be introduced, in which polishing is performed in a reverse rotational direction and with a new polishing pad while under the same condition as the secondary polishing, thereby making it possible to achieve the object of the present invention.

Further, it is also possible to provide two wafer polishing portions in a polishing apparatus, wherein the rotational directions of the two wafer polishing portions are opposite to each other, secondary polishing being performed in the two wafer polishing portions, thereby achieving the object of the present invention. Of course, it is also possible to prepare two polishing apparatuses and effect setting such that the rotational directions of their respective wafer polishing portions are opposite to each other, thus performing secondary polishing on a single wafer with two polishing apparatuses.

Further, while in this embodiment the polishing by the CW rotation is performed first, this should not be construed restrictively; this is only given by way of example for illustrating the idea of reversal of the rotational direction in polishing.

It goes without saying that the above description of the preferred embodiments of the present invention should not be construed restrictively; various modifications and variations are possible without departing from the scope of the invention.

The present invention is not limited to the above embodiments and various changes and modifications can be made within the spirit and scope of the present invention, Therefore, to apprise the public of the scope of the present invention the following claims are made.

This application claims priority from Japanese Patent Application No. 2003-415854 filed Dec. 15, 2003, which is hereby incorporated by reference herein.

What is claimed is:

1. A polishing method of polishing a substrate by rotating the substrate and a pad while keeping the pad in contact with the substrate, said method comprising:

a first polishing step of polishing the substrate by rotating the substrate and the pad in a first direction;

a second polishing step of polishing the substrate by rotating the substrate and the pad in a second direction opposite to the first direction;

a measurement step of measuring asymmetric degree of a mark previously formed on the substrate polished through said first polishing step and said second polishing step; and a determination step of determining a first polishing period in said first polishing step and a second polishing period in said second polishing step based on asymmetric degree as measured in said measurement step.

2. A polishing method according to claim 1, further comprising:

a step of causing the polishing pad used in said first polishing step to be different from the polishing pad to be used in said second polishing step.

3. A polishing method according to claim 1, further comprising:

a storage step of storing in a database a relationship between a sequence of said first polishing step and said second polishing step and asymmetric degree as measured in said measurement step.

4. A method according to claim 3, further comprising a determination step of determining the sequence based on the relationship stored in the database.

5. A method according to claim 3, wherein the sequence is specified by at least one of an order in which said first polishing step and said second polishing step are executed, a period for which each of said first polishing step and said second polishing step is executed, and number of times of execution of each of said first polishing step and said second polishing step.

6. A polishing apparatus for polishing a substrate, said apparatus comprising:

a pad;

a driving system to rotate the substrate and said pad while keeping said pad in contact with the substrate; and a control system to control said driving system so that the substrate is polished through rotation of the substrate and said pad in a first direction and rotation of the substrate and said pad in a second direction opposite to the first direction, wherein said control system determines a period of the rotation in the first direction and a period of the rotation in the second direction based on information on asymmetric degree of a mark previously formed on the substrate.

7. An apparatus according to claim 6, further comprising a measurement system to measure the asymmetric degree.

8. A polishing apparatus for polishing a substrate, said apparatus comprising:

a pad;

a driving system to rotate the substrate and said pad while keeping said pad in contact with the substrate; and a control system to control said driving system so that the substrate is polished through rotation of the substrate and said pad in a first direction and rotation of the substrate and said pad in a second direction opposite to the first direction, wherein said control system stores in a database a relationship between a sequence of the rotation in the first direction and the rotation in the second direction and asymmetric degree of a mark previously formed on the substrate.

9. An apparatus according to claim 8, wherein the sequence is specified by at least one of an order in which the rotation in the first direction and the rotation in the second direction are executed, and a period for which each of the rotation in the first direction and the rotation in the second direction is executed, and number of times of execution of each of the rotation in the first direction and the rotation in the second direction.

* * * * *